United States Patent [19]

De Long

[11] 4,357,881

[45] Nov. 9, 1982

[54] HOSPITAL BED TRAY

[76] Inventor: Harold D. De Long, 1483 Manzanita Ave., Escondido, Calif. 92027

[21] Appl. No.: 203,339

[22] Filed: Nov. 3, 1980

[51] Int. Cl.[3] ..... A47B 23/02; A47C 21/00

[52] U.S. Cl. ..... 108/49; 5/507; 108/47; 108/80; 108/135; 211/88; 211/150

[58] Field of Search ..... 5/507, 508; 108/77, 108/80, 47, 49, 135; 211/149, 150, 88

[56] References Cited

U.S. PATENT DOCUMENTS

| | | | |
|---|---|---|---|
| 1,267,046 | 5/1918 | Beaird | 5/507 |
| 2,082,076 | 6/1937 | Myron | 5/507 |
| 2,881,039 | 4/1959 | Guzman | 297/163 |
| 3,037,214 | 6/1962 | Staiger | 5/507 |
| 3,239,272 | 3/1966 | Wilkins | 211/88 |
| 3,473,772 | 10/1969 | Nilson | 5/507 |

*Primary Examiner*—Alexander Grosz

*Attorney, Agent, or Firm*—Ralph S. Branscomb

[57] ABSTRACT

A tray is adapted to conveniently attach to the siderail of a hospital bed such that when not in use it can be easily collapsed and swung out of the way in depending position from the upper rung of a standard hospital bed siderail.

1 Claim, 7 Drawing Figures

HOSPITAL BED TRAY

BACKGROUND OF THE INVENTION

There is a wide variety of devices provided for specialized hospital purposes, including of course a specialized hospital bed with a siderail which can be raised or lowered to secure the patient or let the patient get out. The standard clipboard used to keep the patient's medication history, etc., has even been adapted to hospital use by magnetizing the back so that it will adhere to the metal rail or the ends of the hospital bed.

Specialized mobile tray units, mobile I.V. solution racks, and other equipment is provided to hold virtually everything that would be needed in a hospital room environment at a convenient height and position.

However, for the patient who rents the hospital bed for home use, there is of course a lack of the sophisticated equipment and accessories available in the hospital room, and due to the height of the hospital bed siderail, conventional tables often are at an inconvenient height for easy access by the patient to medicines and food, pencils, paper and other items required by a bedridden invalid.

SUMMARY OF THE INVENTION

The present invention fills the above-stated void by providing a tray which is conveniently attached to the rungs of the siderail of a hospital bed. The unit is designed to easily snap into place over the upper rung of the siderail, with a pivotal brace which clamps into a lower rung.

In the event it is desirable to swing the unit out of the way for spacial considerations, the principal embodiment is provided with a recessed channel into which the brace swings and is secured when the unit is not in use, permitting the tray surface to swing down flush against the side of the rail rungs.

DETAILED DESCRIPTION

Figure 1:
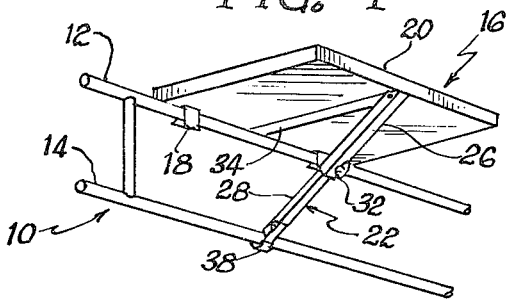
FIG. 1 is a perspective view from underneath the tray showing it installed on a siderail.
Figure 2:
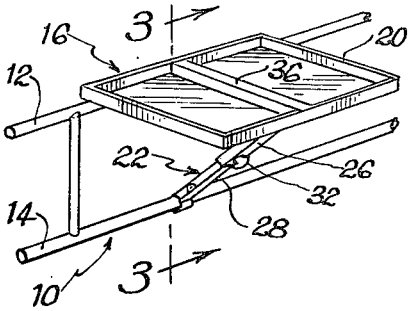
FIG. 2 is a perspective view of the device as shown in FIG. 1, but seen from above.
Figure 3:
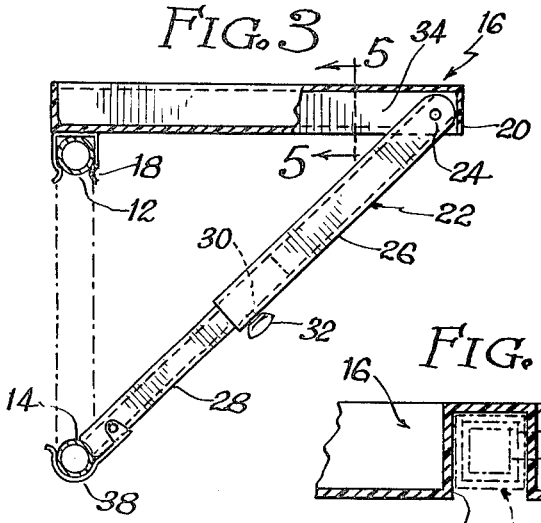
FIG. 3 is a section taken through line 3—3 of FIG. 2.

The accessory tray attaches to a standard siderail 10 of a hospital bed which defines upper and lower horizontal rungs 12 and 14, respectively. The body of the tray is shown at 16 and mounted thereto along the inside edge are a pair of clamps 18 which pressure-snap over the upper rung 12 to secure the tray pivotally thereto. The tray itself has a peripheral lip 20 for the purpose of retaining items thereon, and underneath is a brace 22 which is pivoted at its outside end at 24 to the outer edge of the tray. The brace could be of standard length, but preferably is made in two telescoping adjustable pieces 26 and 28, the outside piece having a threaded hole 30 engaging a wingnut detent 32 as can be visualized from FIG. 3.

Figure 4:
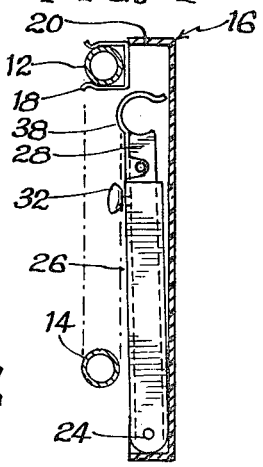
FIG. 4 is a section taken along the same line as FIG. 3 but with the tray in its depending position.

Ideally, the brace can be swung out of the way so that the tray can pivot downwardly to the position shown in FIG. 4, still on the siderail, but for all intents and purposes, completely out of the way. To accommodate the brace, a recessed channel 34 is defined in the bottom of the tray body, causing a divider rib 36 in the top to help prevent objects from rolling or being knocked from one side of the tray to the other, a problem which is exaggerated in the instant application due to the immobility of the bedridden invalid.

Figure 5:
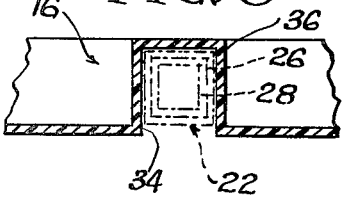
FIG. 5 is a section taken along line 5—5 of FIG. 3.

As shown in FIGS. 4 and 5, the pivotal brace 22 can be swung completely inside the channel 34, and would be retained there by a friction fit or some resilient detent structure could be provided in the outer edges of the channel. When the unit is collapsed in this fashion, it is also useful for storing and shipping, inasmuch as the telescopic pivoted brace does not flop about and extend undesirably.

At the bottom end of the brace 22, is an over-the-center spring clip 38 which is pivoted over the bottom rung to positively snap into place to prevent accidental dislodgment of the tray by one bumping from the outside. The tray is also usable extended either interiorly of the gate or exteriorly, so bumping by the patient is also prevented by the simple expedient of the positive engagement of the bottom rung 14 with the over-the-center spring clip 38.

Figure 6:
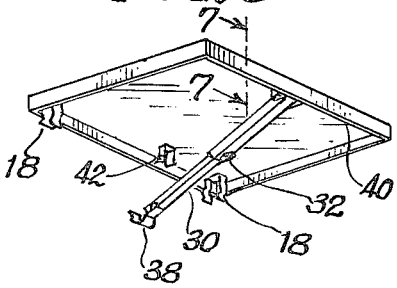
FIG. 6 is a perspective from underneath a slight modification of the invention.
Figure 7:
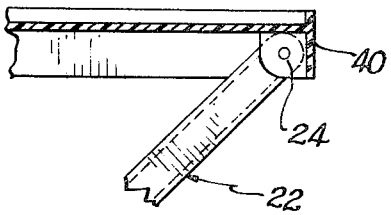
FIG. 7 is a section taken along line 7—7 of FIG. 6.

A slight modification of the invention is shown in FIGS. 6 and 7, wherein the tray body portion defines a peripheral skirt 40 and the telescopic brace 22 is retained by a clip 42 rather than being received in a channel. Because of the peripheral lip, to which the clamps 18 are mounted, when the shaft is collapsed, it is out of the way to permit falling of the tray downwardly, pivotally around the top rung, much as in the first embodiment.

In either embodiment, the invention provides an easy-to-use, inexpensive device which ameliorates the life of bed-ridden persons by providing in very easily accessible fashion, either inside or outside of the bed area proper, those items of medicine or other necessities which might well otherwise require the more constant presence of an aide.

I claim:

1. For a hospital bed having a siderail defining an upper rung and a lower rung, an accessory holder attachable to said rungs comprising:

(a) a tray having an inside edge;

(b) means adjacent the inside edge of said tray for clamping onto said upper rung;

(c) an elongated brace pivotally mounted at one end to said tray and having means at the other end to engage said lower rung and support said tray in generally horizontally extended position;

(d) said brace being telescoping to accommodate rails of different rung spacing;

(e) said means for clamping onto said upper rung clamping pivotally such that said tray may be swung down into a generally depending horizontal position when said brace is released from said lower rung;

(f) said tray defining a recessed channel in the lower surface thereof, and said brace is pivotally mounted in said channel such that same will swing into said recessed channel when not in use, and including means to retain same in said channel; and (g) said tray being formed generally as a sheet and said recessed channel in the bottom thereof forms a divider in the top thereof.

* * * * *